US006394441B1

(12) United States Patent
Cruz et al.

(10) Patent No.: US 6,394,441 B1
(45) Date of Patent: May 28, 2002

(54) HANDLING STAPLED DOCUMENTS FOR POST-PROCESSING OPERATIONS USING MAGNETIC FORCES

(75) Inventors: Israel Cruz; Marco A. Guerrero; Roberto Obregon, all of Jalisco (MX)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/368,623

(22) Filed: Aug. 4, 1999

(51) Int. Cl.[7] ..... B31B 1/28

(52) U.S. Cl. ..... 270/37; 493/469; 493/424; 493/442; 493/454

(58) Field of Search ..... 270/37, 32, 39.06; 493/424, 434, 442, 454, 469; 412/1; 414/788.9

(56) References Cited

U.S. PATENT DOCUMENTS 1,701,055 A * 2/1929 Sheldon ..... 493/469 X
2,551,186 A * 5/1951 Veyret et al. ..... 493/469 X
3,884,132 A * 5/1975 Snodgrass ..... 493/469 X
4,623,291 A * 11/1986 Buck ..... 414/788.9
4,819,414 A * 4/1989 Worden et al. ..... 493/434 X

* cited by examiner

*Primary Examiner*—Christopher P. Ellis
*Assistant Examiner*—Patrick Mackey

(57) ABSTRACT

Folding of stapled documents is accomplished by using magnetic force to manipulate the document. The magnetic force is applied to the staples in the document and results in movement of the document when the magnetic force is applied. Since the magnetic force is applied at the staples, paper handling operations, such as folding are accomplished with the document aligned in accordance with a staple line. Magnetic force can further be used to transport documents to desired locations, such as individual output bins.

15 Claims, 19 Drawing Sheets

HANDLING STAPLED DOCUMENTS FOR POST-PROCESSING OPERATIONS USING MAGNETIC FORCES

FIELD OF THE INVENTION

The present invention relates to paper handling. More specifically, the invention relates to folding and manipulation of stapled documents.

BACKGROUND OF THE INVENTION

One commonly used method of permanently fixing multiple pages is stapling of the pages. When print jobs are produced by laser printing, photocopying and other short-run processes, it may be desired to fold or otherwise manipulate assembled documents. In the prior art, this was either done by hand, or by the use of paper handling equipment, such as sheet folders.

One of the aspects of sheet folders is that it was necessary to separately align individual documents. This increased the expense of paper folding equipment. In addition, the staples present alignment problems, particularly if staples are to be in alignment with the fold. Generally, the fold should occur along a staple line.

In the case of documents which are produced by the use of laser printers or photocopiers, any additional procedures involved in producing a final product, such as folding equipment, require the use of additional equipment. This additional equipment would be either within the printer or external to the printer, but in either case requiring additional expense and bulk. That means that the ability of providing office printers which are capable of providing assembled booklets or other multi-page brochures is limited. It would be desired to provide a printer arrangement which allows assembly of multiple sheets of paper or other sheet media, but does not require a substantial investment in additional equipment for folding and other paper handling purposes. It is desired that the additional features be provided without making the printer or copier substantially more complicated or less economical to operate. It is therefore desired to provide a simplified automatic paper folder for such equipment.

In providing such a paper folder, it is important that the staples be aligned when using a folding blade or other creasing device. If the staples are not aligned, the folding line will occur at the wrong position on the document. While having the staples in a staple line collinear to a fold is a minor inconvenience; an angular misalignment creates an unsightly appearance and is also objectionable to readers of the document. Angular misalignment is more critical and can result in the staples being skewed, as well as the folded document itself being skewed with respect to itself. Thus, if an 11"×17" ledger or (double letter size, 27.94×43.18 cm) document is folded to form two letter size halves per sheet, a 1° misalignment will result in an offset in the x and y directions of 4.8 mm and 3.8 mm, respectively. FIG. 1 shows the results of misalignment of such a job in millimeters of offset versus angular alignment when using ledger size sheets.

In the prior art, mechanical force is used to transmit motion to a "feeding blade" or to create a "buckle" in the sheets. This requires either a motor or additional mechanism to cause this mechanical force. The feeding blade can get stuck between folding rollers, especially when folding documents having large numbers of sheets. At that point, a high force is needed to release the feeding blade and causes the document to be marked by the exertion of the release force.

It is also necessary to position the job extremely accurately; otherwise, the folding line will not be centered or will not be perpendicular, causing an unacceptable booklet quality.

In addition, the paper folding mechanism must, prior to folding the documents, transport the documents to an appropriate location for folding. This means that, often after the documents are assembled or otherwise sorted at a discharge end of a printer, these documents must again be handled. This can result in mishandling of the documents and of course results in increased complexity of the equipment.

In describing the invention, the term "paper" is used to describe paper, as well as other forms of sheet media. "Document" is intended to describe one or more sheets which may be in the form of a booklet. A "print job" may include multiple copies of a document. A document can take a number of forms, but is often an assembly of sheets of paper or other sheet media. In this invention, the documents are generally bound by a row of staples. Typically, this is a "booklet," sometimes called "saddle stitch and fold." A booklet has more than one page, usually two to five or more pages. It has one or more staples that hold the pages together. The staples are located along a line, approximately at the middle of the page. Unless portions of the booklet are intentionally offset, and after the pages are stapled, the pages are folded along a staple line, meaning a line defined by the staples.

Typically, the process to make a booklet is to add a set of staples, usually in the middle of the sheet, as shown in FIG. 2. Once the document is stapled, it is folded at the center line so that it has a book appearance, as shown in FIG. 3. In a "feeding blade" approach, a document is positioned extremely accurately, so that the staples are nearly exactly above a feeding blade and below a nip defined by a pair of folding rollers. The feeding blade is then shifted toward the nip in order to feed the stack of papers toward the nip of the folding rollers. By friction, the folding rollers grab the stack. At this time, the blade retracts back to its original position away from the nip, thereby avoiding the feeding blade being trapped by the feeding rollers. This procedure is shown in FIGS. 4 and 5.

There are two key points in the process in which accuracy is essential. The first is when the blade initiates the feeding movement. At that time, the staples must be precisely aligned with the blade. If this does not occur, the folding line will be at the wrong position, or diagonal to the edge of the stack. This would make the booklet unacceptable. This misalignment is shown in FIG. 6, and is important in order to achieve a proper print job. The misalignment can be characterized, referring to FIG. 6, by the following equations:

FIG. 6. Impact of the Alignment of the Job $$a + b = l$$

$$\tan\theta = \frac{\frac{(b-a)}{2}}{\frac{h}{2}} = \frac{b-a}{h}$$

$$\tan\theta = \frac{2b-1}{h}$$

$$b = \frac{h\ \tan\theta + 1}{2}$$

$$\cos\theta = \frac{x+a}{b} = \frac{x+1-b}{b}$$

$$\sin\theta = \frac{y}{b}$$

$$\sin\theta = \frac{2y}{h\ \tan\theta + 1}$$

$$y = \frac{h\ \sin\theta\tan\theta + 1\ \sin\theta}{2}$$

-continued $$1+\cos\theta=\frac{2(x+1)}{h\ \tan\theta+1}$$

$$\frac{(1+\cos\theta)(h\ \tan\theta+1)}{2}-1=x$$

$$x=\frac{h(\sin\theta+\tan\theta)+(1+\cos\theta)}{2}1$$

According to these equations, a 1° misalignment when folding an 11"×17" (ledger size or double letter size sheet) would represent an offset of x=4.8 mm y=3.8 mm FIG. 1 shows the behavior of the variables x and y, when the angle varies from 0° to 20° in a ledger size booklet. The steep slope of these lines is notable.

In another prior art technique, a "buckle approach" is used. This is schematically shown in FIGS. 7. In FIGS. 7A and B, a stack of sheets is fed until the leading edges of the sheet find a stop. As the feeding process continues, the stack is forced to deform upwards, as shown in FIGS. 7C and D, creating a buckle. When the buckle is high enough, it contacts a pair of folding rollers, which by friction grabs the stack and creates the folding line, as shown in FIGS. 7D–F. This method has the disadvantage of being hard to control with respect to accuracy of the alignment of the folding line. This is particularly problematic with respect to linear alignment, although angular alignment also creates problems.

SUMMARY OF THE INVENTION

In accordance with the present invention, magnetic forces are used in order to manipulate assembled documents for further processing. This is accomplished by using the ferromagnetic characteristics of binding elements of the document, typically staples, in order to accomplish such manipulation. The magnets, because they are able to align with the staples, use the previously established registration of stapled jobs in order to provide a controlled and neat stack of multiple paper documents. The magnets permit transportation of stapled documents in order to sort the documents or for sending the documents to a different location. It is also possible to use the magnets to rotate documents, flip (invert) the documents, and feed the documents in order to perform additional finishing operations. In general, the invention provides a convenient way to handle and control a stapled document as needed.

In a further aspect of the invention, the magnetic force is used to establish a registration of a fold line, by lifting a document along a staple line, thereby establishing the fold line at the staple line and in alignment with the staple line.

Magnetic force is substituted for mechanical force in feeding a print job into the nip of rollers. Such magnetic force may be either a permanent magnet or an electromagnet, depending upon the specific configuration of the folding mechanism. By precisely locating and distributing the magnets, it is possible to have magnets automatically align the job by actuating on the staples. This allows the folding equipment to generate a folding line precisely where required without having to position the job with the precision that current methods require. In the preferred embodiment, electromagnets are used because:

1. It is possible to control the magnetic force according to the size of the job. Since more pages imply more weight to be transported, higher magnetic force may be required.

2. There will always be a time when it is necessary to release a stack. When using an electromagnet, this operation can be as simple as deactivating it and the magnetic force will be zero, releasing the staples and the job on a predefined position or location. Additionally, electromagnets offer the possibility of degaussing the staples after the magnetic force is applied to them.

By the use of magnetic force, it is possible to move or transport stacks in any of the large number of directions, including vertical, horizontal, horizontal sideways, flip, rotate, etc.

The arrangement of a particular array of magnets would of course be dependent upon the application. For example, in the folding process to create a booklet, it is possible to provide a pair of magnets to align with pairs of staples along a staple line. This assumes that the booklet is rendered with at least two staples.

Advantages of the invention include the fact that it is possible to implement the invention without adding an additional motor or mechanical device. It is possible to avoid the use of a mechanical part which could be caught between the rollers during operation in a manner of a blade and nip arrangement. In addition, by using the magnets, it is not necessary to accurately pre-position a stack. This is because the stack will be aligned automatically by the magnetic field operating on the staples.

In addition, it is possible to have more control of the job and of the positioning of the stack. The magnetic force can be varied in order to account for the weight and friction of the stack, as well as variations in the frictional forces acting upon the stack. The magnetic force can also be used to help control the movement of the stapled document. This magnetic force can be regulated easily and can even be turned off.

In accordance with a further aspect of the invention, a nip roller arrangement is provided that in which at least one magnet is located in a position along one of the nip rollers. As the stack is moved past the nip rollers, the magnet attracts the staple and pulls the stack up between the nip rollers. This causes the stack to be folded by the nip rollers along the staple line. The job can be released either by deactivating the magnetic force or by mechanically blocking the paper path.

In a further aspect of the invention, non-stapled jobs are provided with a temporary ferromagnetic device, such as a clip. The positioning of the clip is accomplished first and is removed subsequent to the paper handling, or removed by the end-user manually.

In accordance with a further aspect of the invention, the use of magnetic force to manipulate paper documents is combined with buckling or with blade and nip roller techniques. This permits the use of such techniques while providing the advantages of alignment and ease of manipulation afforded by the use of the magnets.

In accordance with a further aspect of the invention, an array of magnets is used to lift and transport stapled documents by the staples. Further mechanisms such as folding mechanisms and sorting trays may then be used to accomplish further paper handling functions, including folding and sorting. In accordance with a further aspect of the invention, a magnetic device is used to handle a stack of documents by means of attraction of a piece of ferromagnetic material. This permits the performance of one or more complex paper handling operations.

The use of staples is normally associated with multiple sheets in a stack. It is, however, entirely possible to accomplish paper folding and other paper handling tasks when using a single sheet. Therefore, within the concept of this invention, a stack may include one or more sheets of paper. In particular, when a removable or temporary ferromagnetic clip is used, the invention can very easily function with single sheet stacks.

BRIEF DESCRIPTION OF THE DRAWINGS

FIG. 13 shows a mechanism with multiple mechanism with multiple bin;

FIG. 14 shows a magnetic roller pair lifting and folding a document;

FIG. 15 shows the document picked up in FIG. 14 being transported by the conveyor;

DETAILED DESCRIPTION OF THE PREFERRED EMBODIMENTS

Figure 1:
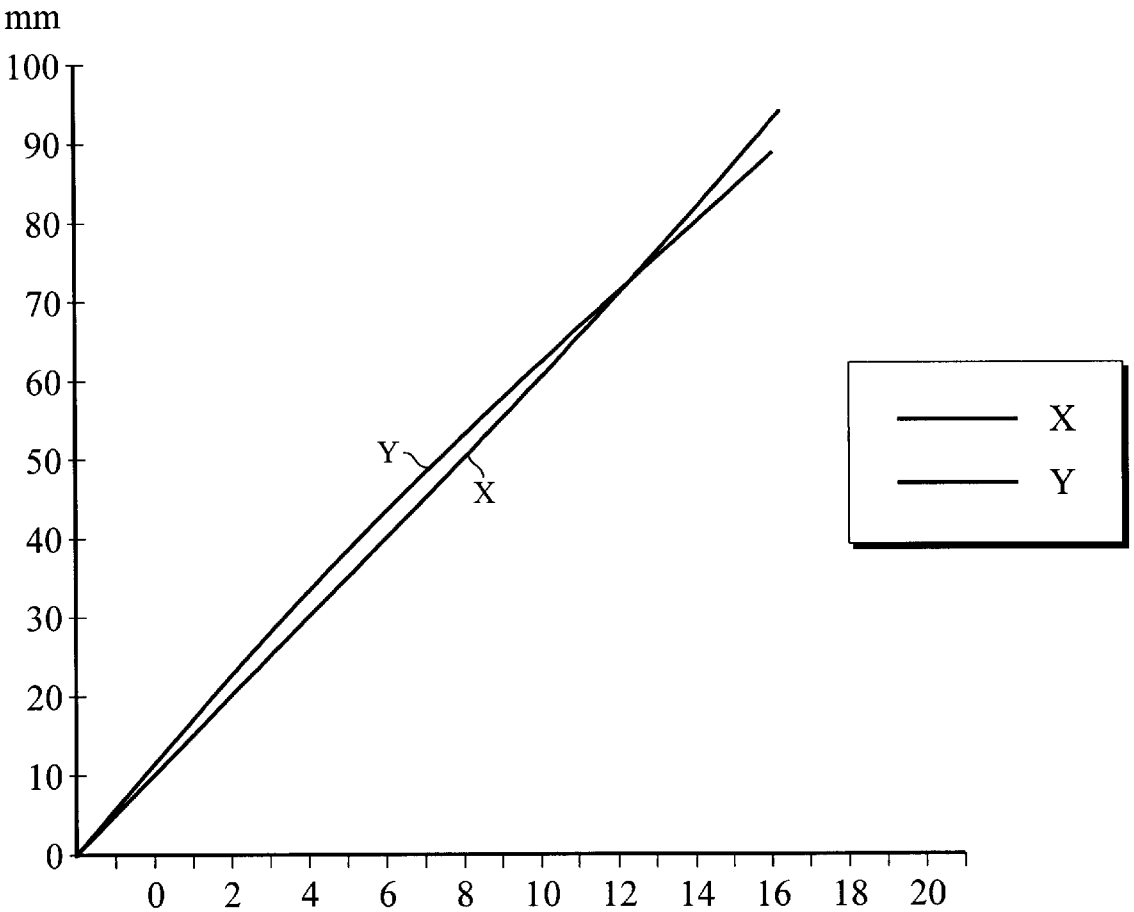
FIG. 1 shows a graphic relationship between distance of misalignment and angular misalignment.
Figure 3:
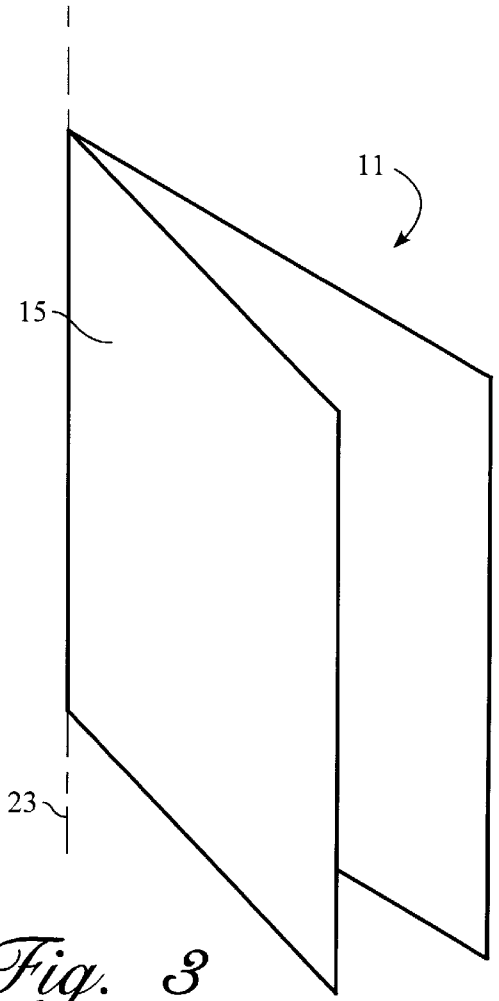
FIG. 3 shows the stack of FIG. 2, after having been folded.
Figure 2:
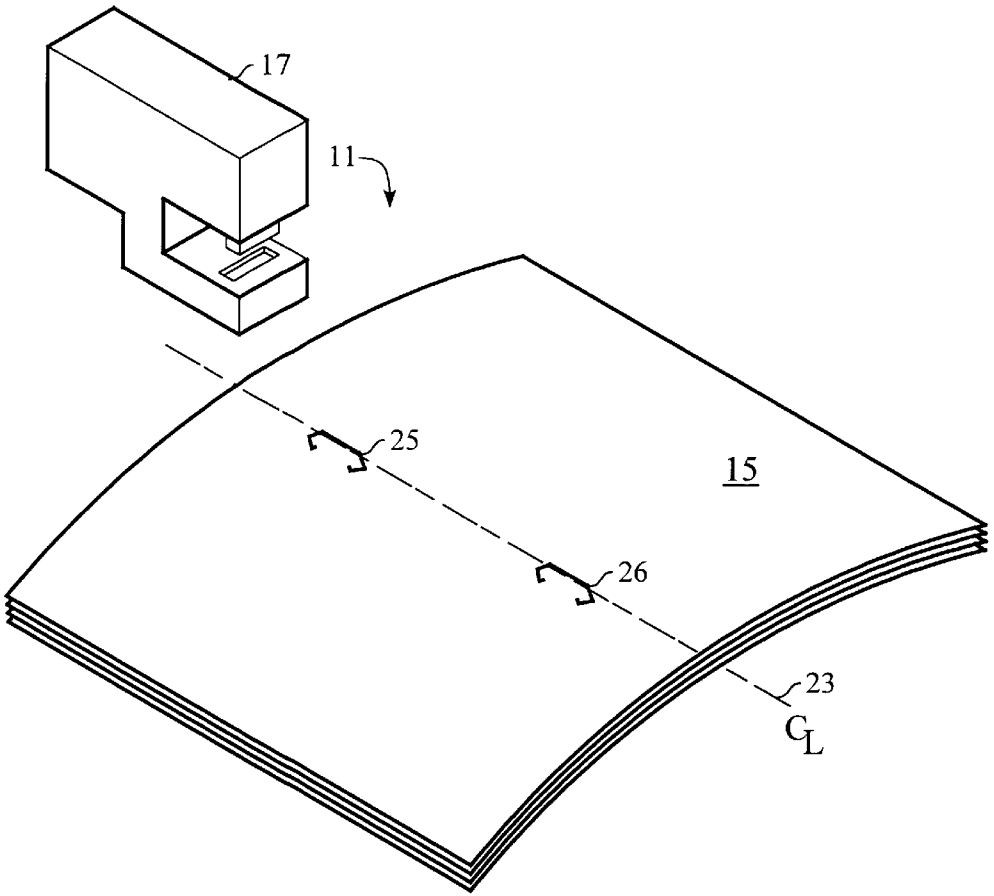
FIG. 2 shows staple alignment in a stack of sheets.
Figure 4A:
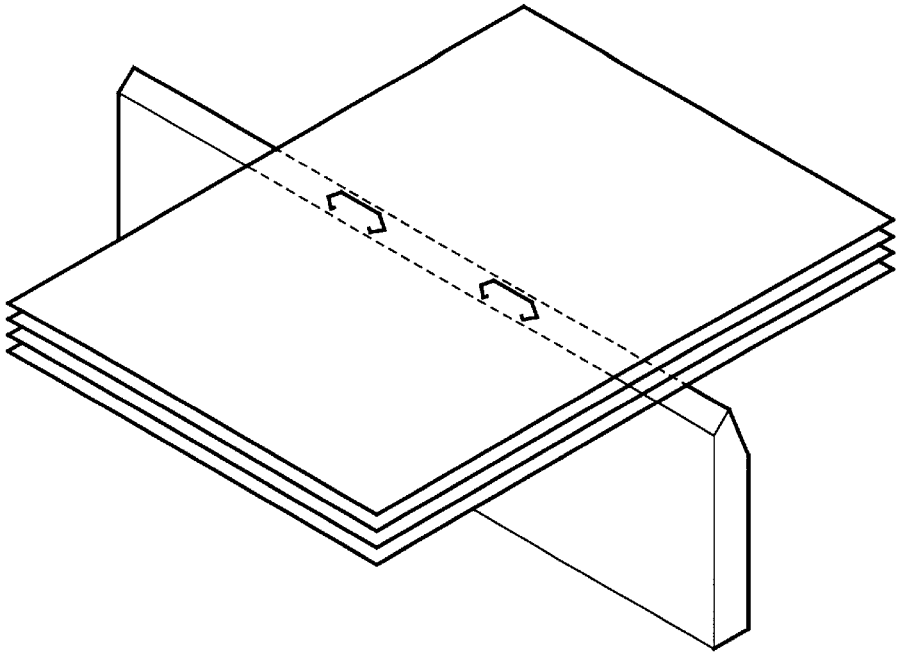
FIGS. 4A–B show the alignment of a stack prior to folding, using a knife and nib folding technique.
Figure 4B:
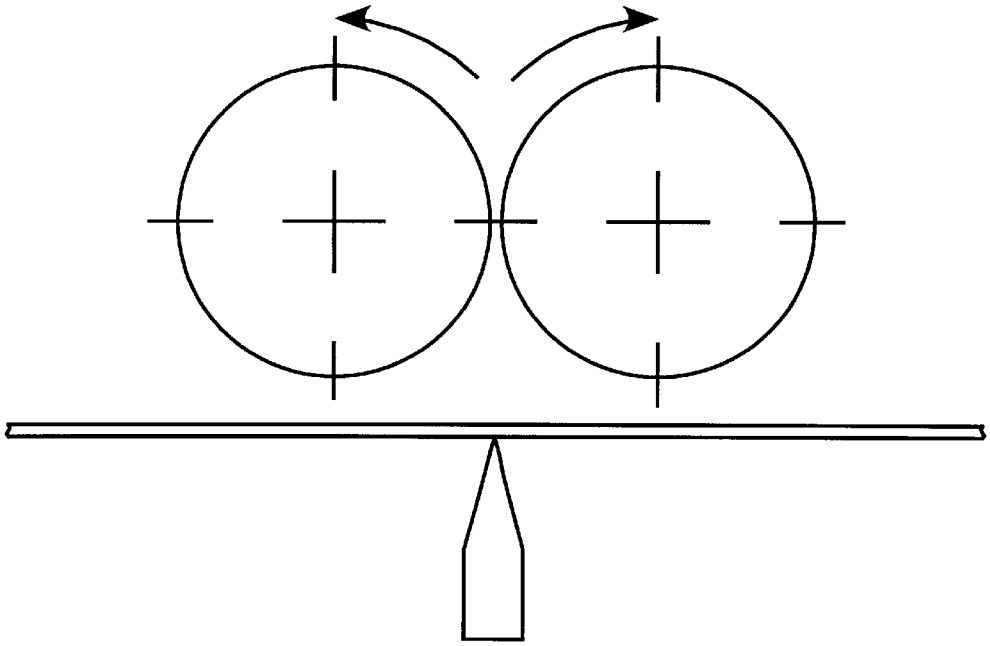
Fig. 4B (Prior Art)
Figure 5A:
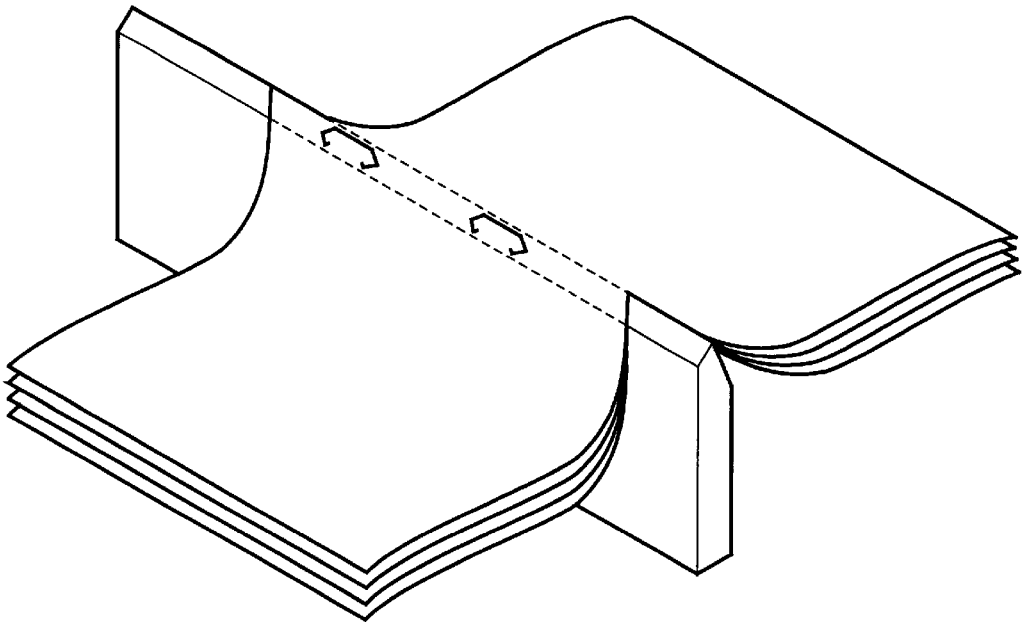
FIGS. 5A–B show the alignment of the knife and the stack during the folding process.
Figure 5B:
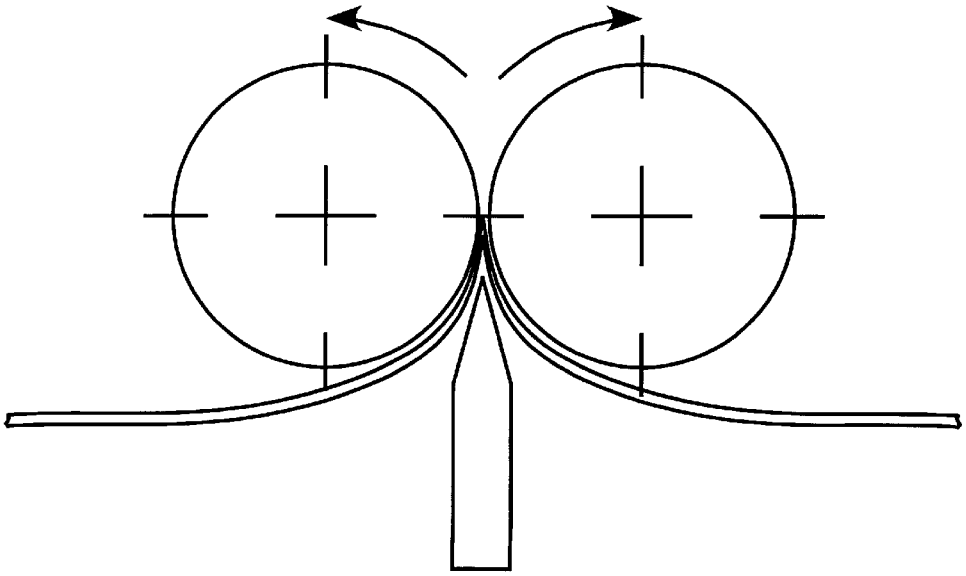
Fig. 5B (Prior Art)
Figure 6B:
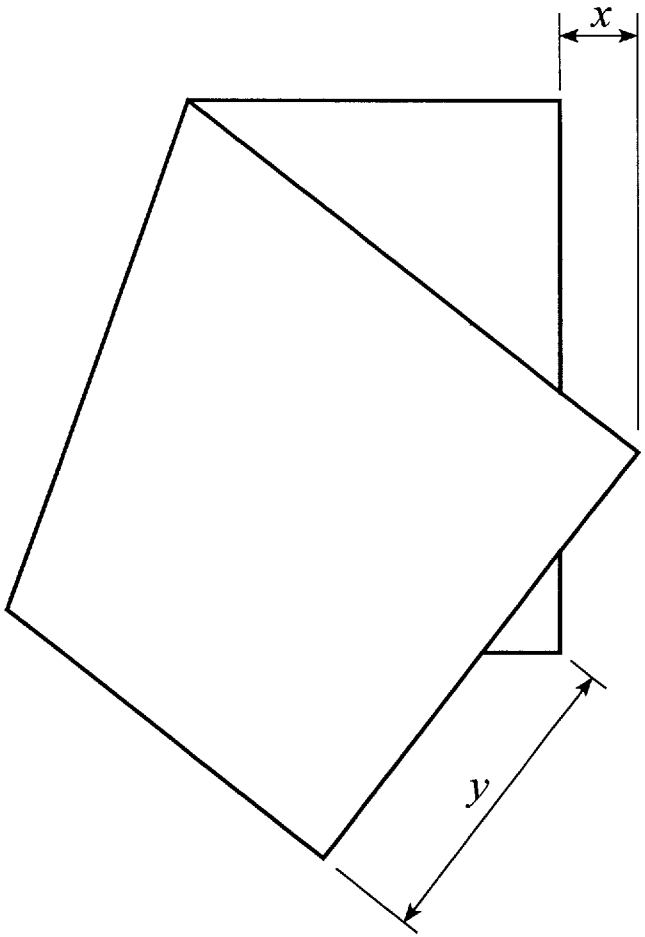
FIG. 6 shows alignment measurement for a stack.
Figure 6A:
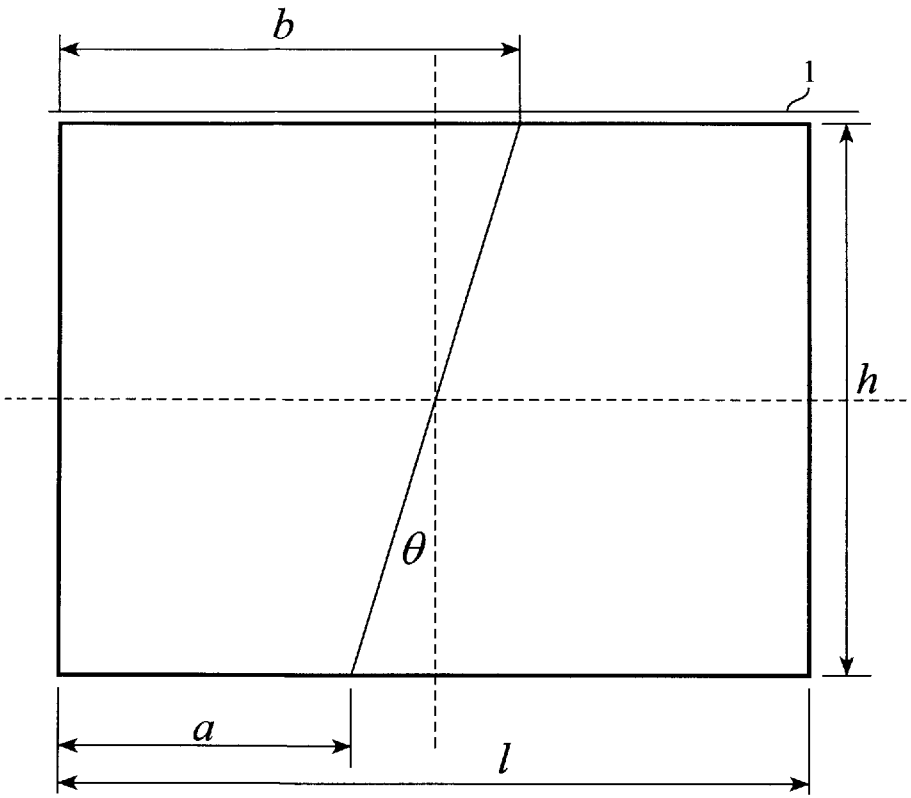
Figure 7A:
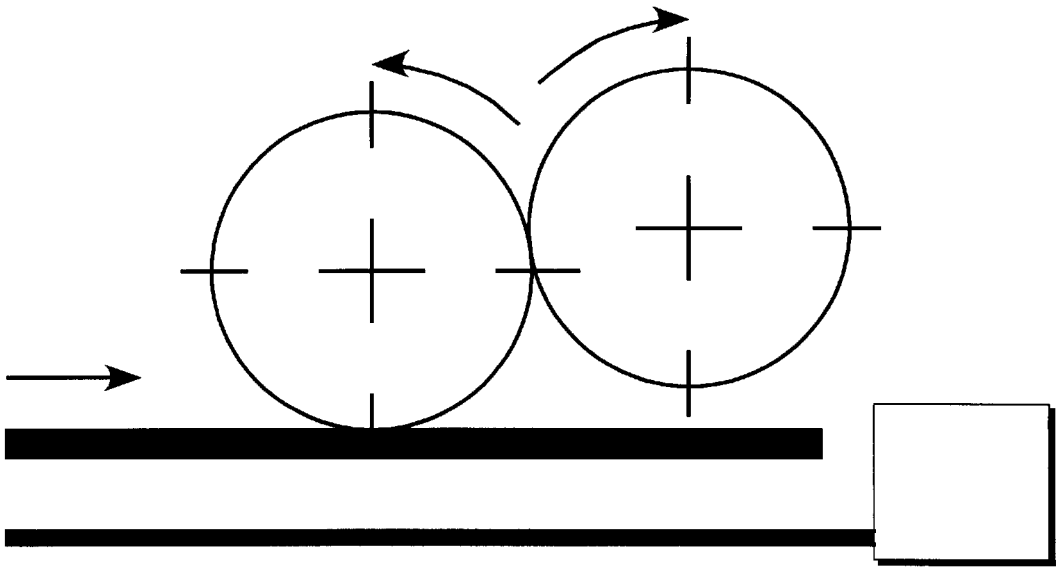
FIGS. 7A–F show the holding of a document from the staples.
Figure 7B:
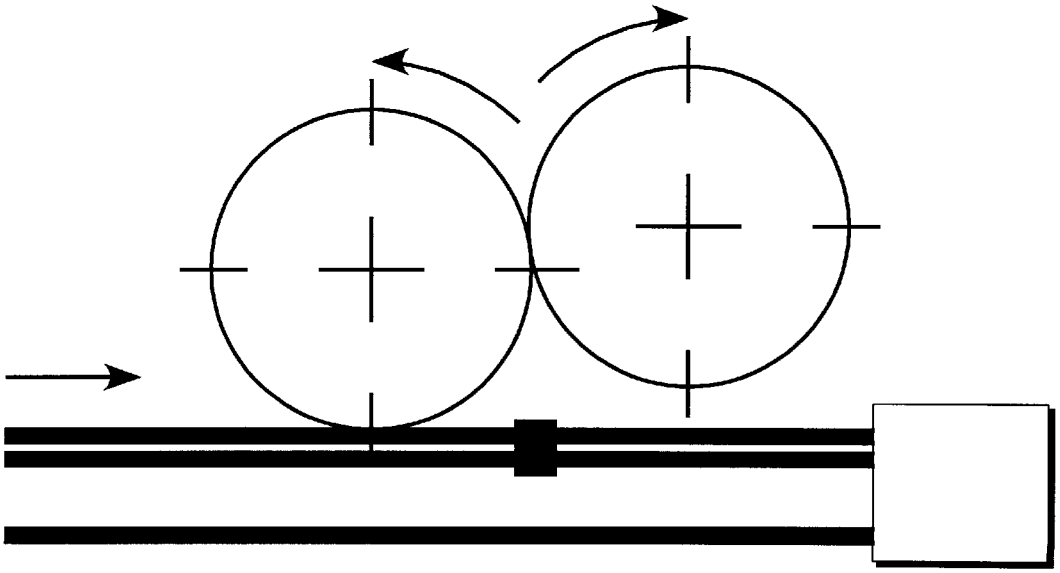
Figure 7C:
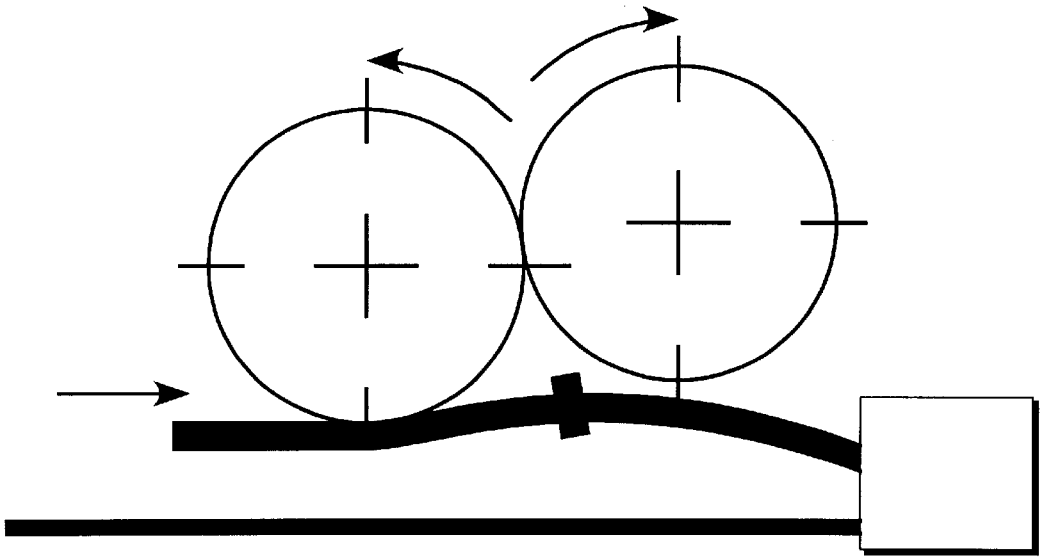
Figure 7D:
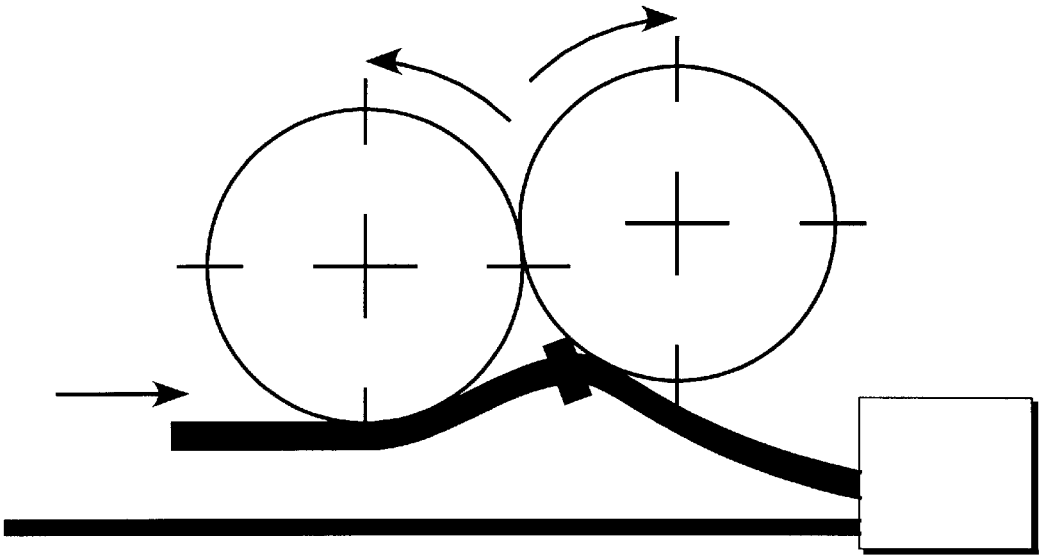
Figure 7E:
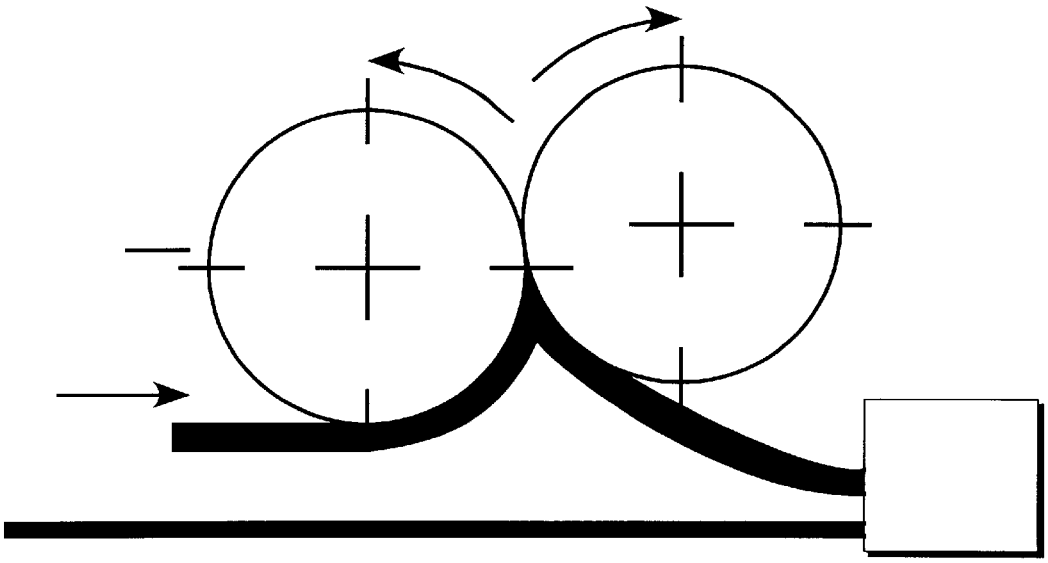
Figure 7F:
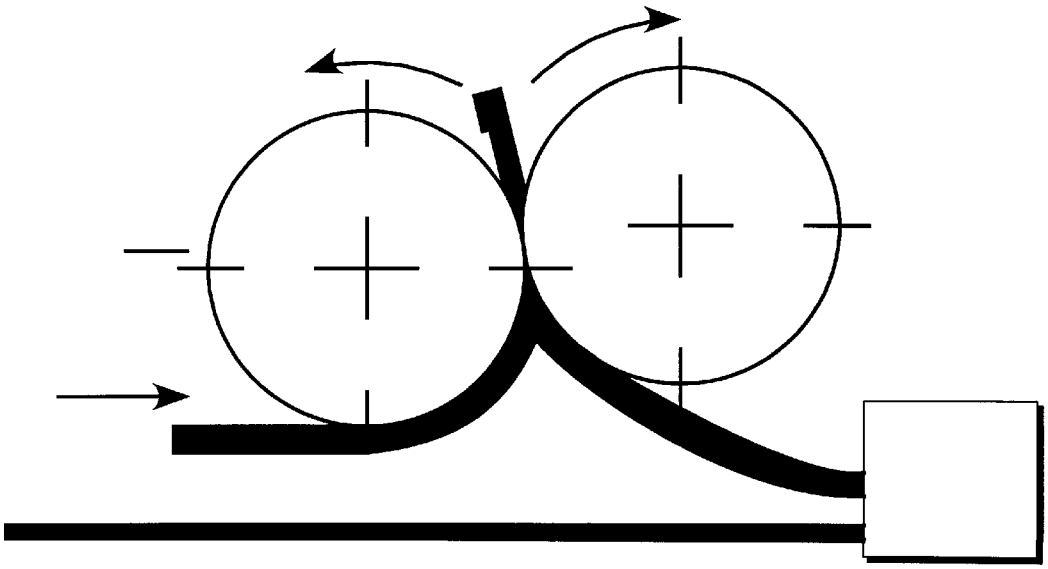

FIGS. 2–3 show an arrangement of a document 11 formed into a booklet. In final form, the booklet consists of printed material on each side of half pages. Therefore, looking at an outer sheet 15 shown in FIG. 2, a first and last page of the document is visible. On the reverse side of sheet 15 and not visible on that particular sheet is a second and next-to-last page. When the document 11 is folded, the beginning and ending pages will, of course, appear on respective sides of the sheet. As will be seen, the document 11 consists of a stack of sheets, such as sheet 15, and can, in its final assembled form be a booklet.

Therefore, in producing the completed document 11, the sheets are stacked and stapled, as symbolically represented by stapler 17. After stapling, the sheets are stacked and stapled. After stapling, the halves are folded to result in the folded booklets as shown in FIG. 3. The fold occurs along a staple line 23 which is defined by staples 25, 26. In the usual case, the staple line 23 occurs half way across the stack of sheets forming the booklet; however, if desired, the staple line 23 can be offset. However, in its final form, the booklet 11 will be folded along the staple line 23 as shown in FIG. 3.

Figure 8B:
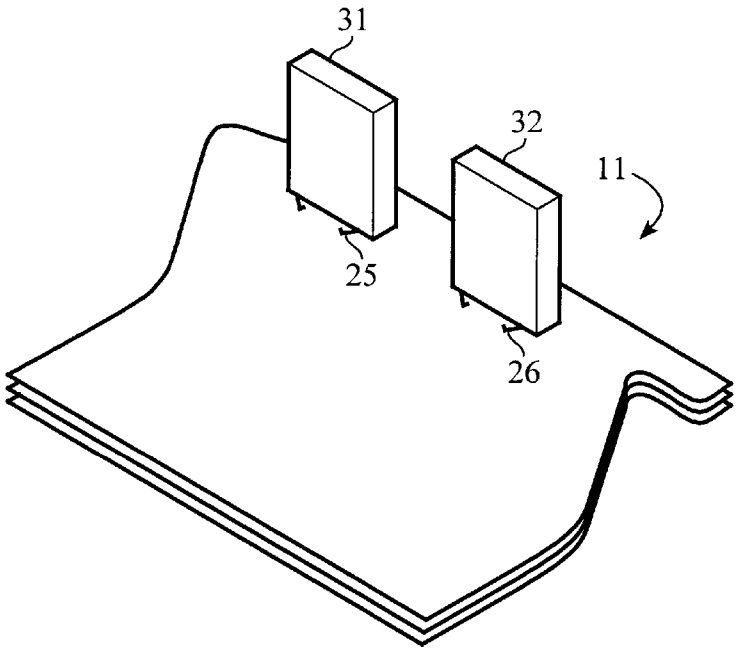
FIGS. 8A–B show folding of a document using the buckle method and a pair of nib rollers.
Figure 8A:
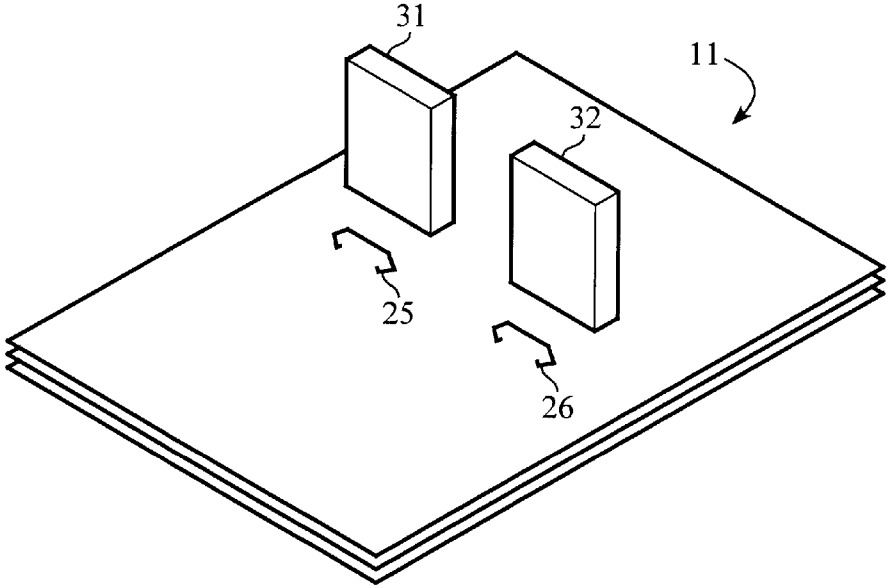

Referring to FIGS. 8, the staples 25, 26 allow the stack 11 to be manipulated by use of magnets 31, 32. FIG. 8B shows the stack 11 forming an apex along the staple line 23. The apex is a result of the stack 11 being picked up by the staples 25, 26. As can be seen, the magnets 31, 32 are able to perform two major functions:

1. manipulate the stack 11 by picking up the stack; and
2. establish an apex along the staple line 23. Therefore, the magnets 31, 32 can be used to manipulate the document 11.

Figure 9:
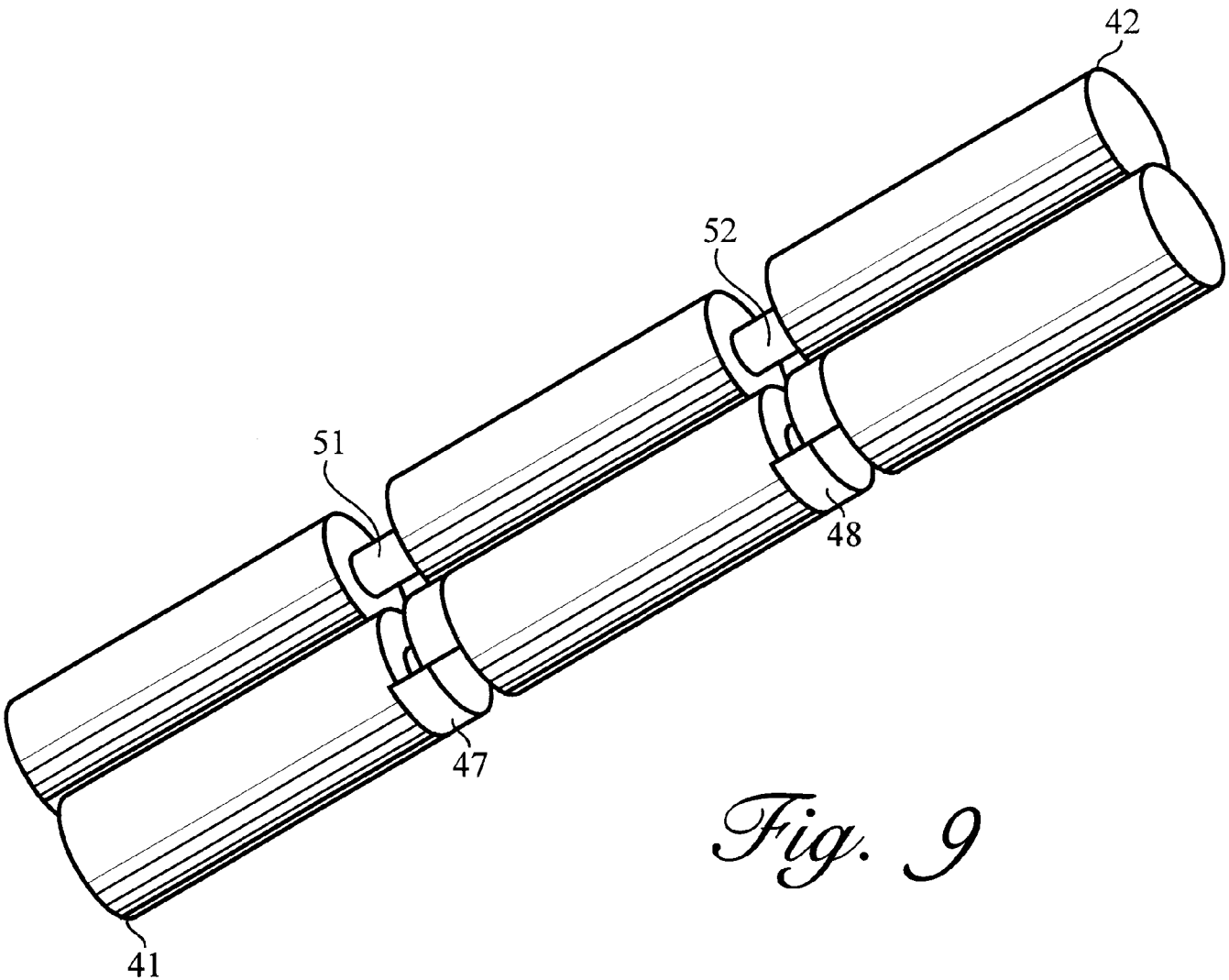
FIG. 9 show the use of magnetized nib rollers to pick up a stapled print job.
Figure 10:
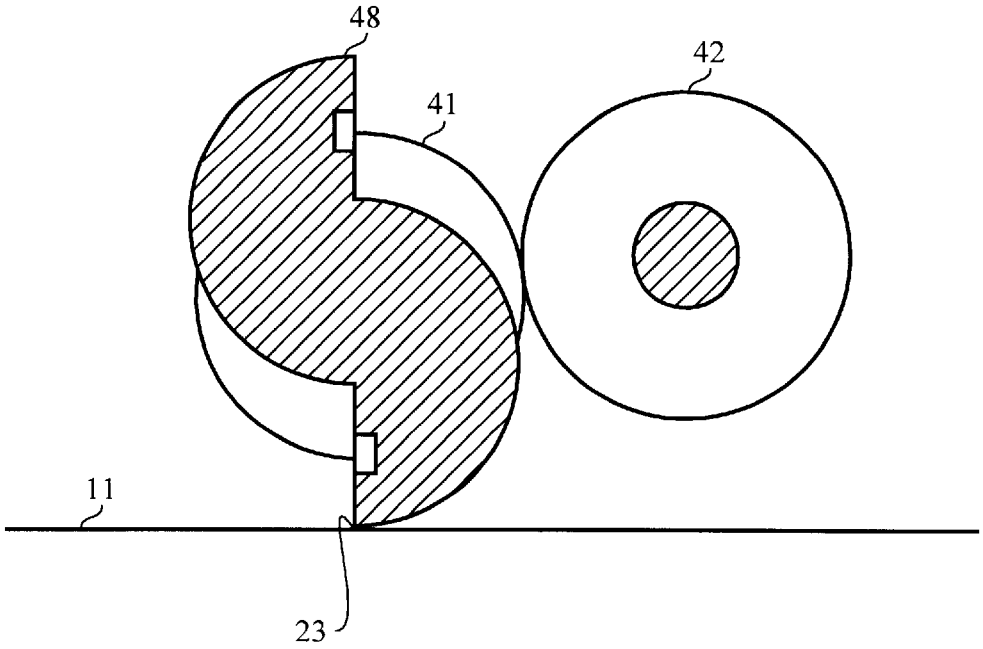
FIG. 10 shows an arrangement in which magnetic forces are used to assist a knife and nib mechanism.

Referring to FIGS. 9—13, a pair of nip rollers 41, 42 are provided with magnetic inserts 47, 48. The magnetic inserts 47, 48 are aligned and spaced along roller 41 so as to attract the passing document 11 by the staples along staple line 23 as shown in FIGS. 9 and 10.

Figure 11:
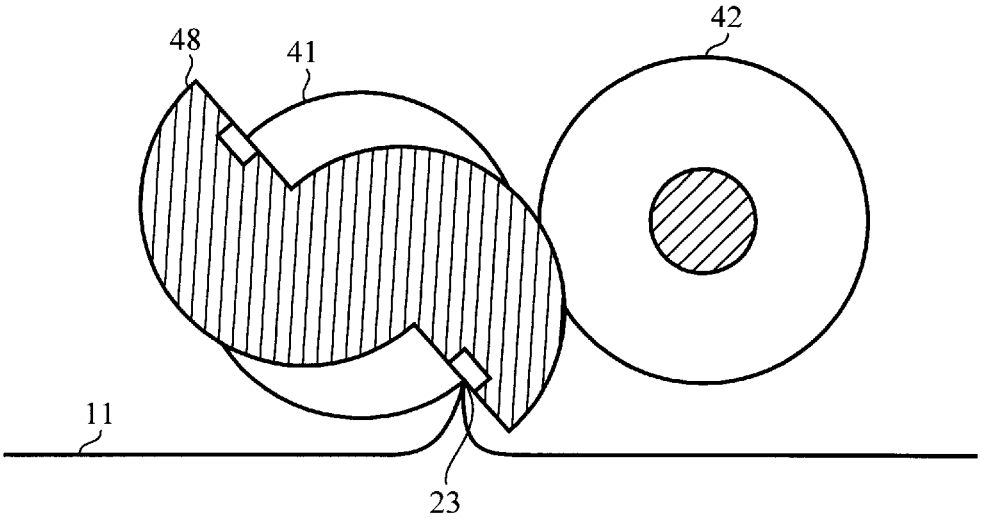
FIG. 11 shows an arrangement in which magnets are used to assist a buckle-type folding mechanism.
Figure 12:
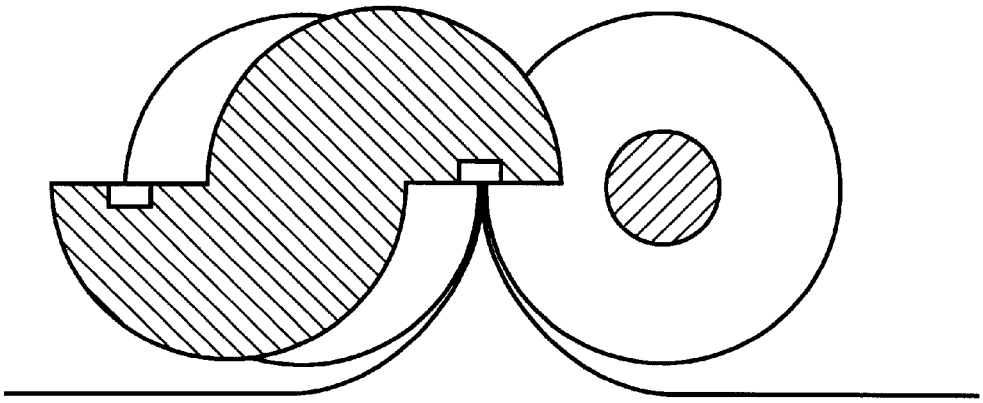
FIG. 12 shows a pair of nib rollers picking up a stack by attracting the stack along a staple line.
Figure 13:
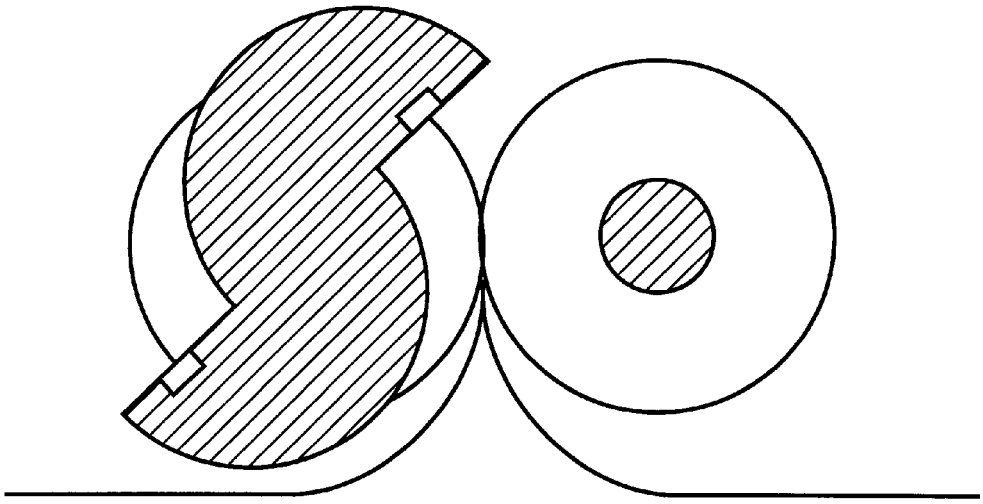
FIGS. 13–15 show magnetically assisted paper moving equipment.

In FIG. 10, the magnets, including magnet 48, attract the staples, causing document 11 to align along staple line 23. In FIG. 11 there is roller 41 rotates, the magnets, including magnet 48, pick up the document 11, thereby forming an apex at the staple line 23. FIGS. 12 and 13 show the document 11 being pulled between the nip rollers 41, 42, thereby folding the document 11. In this particular case, the pair of magnets 47, 48 are used to attract two staples on a document. In the configuration shown, the magnets 47, 48 extend slightly from the circumference of the roller 41, thereby necessitating corresponding slots 51, 52 in roller 42. Since the remaining portion of the nips 41, 42 compress the document 11 at the staple line 23, the fold is well established.

The arrangement shown in FIGS. 9–13 does not detail any assistance provided external to the magnets 47, 48 in attracting the document 11. It is possible, however, to use other techniques in order to attract the document 11.

Figure 14:
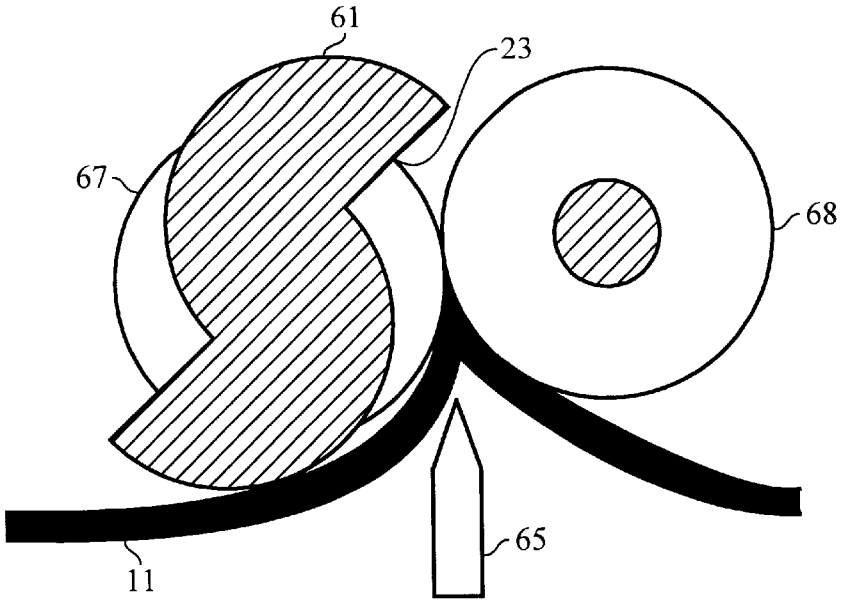

FIG. 14 shows a document being attracted by a pair of magnets, such as magnet 61. In addition to the magnetic attraction provided by the magnets (shown at 61), a blade 65 is used to help form the buckle along staple line 23. Since magnetic force is used to pull the document 11 between the rollers 67, 68 the precise alignment of the document 11 with the blade 65 is less essential. It is also less essential that the blade 65 extend very far between the rollers 67, 68, and this reduces the tendency of the knife blade 65 to become caught between the rollers 67, 68.

Figure 15:
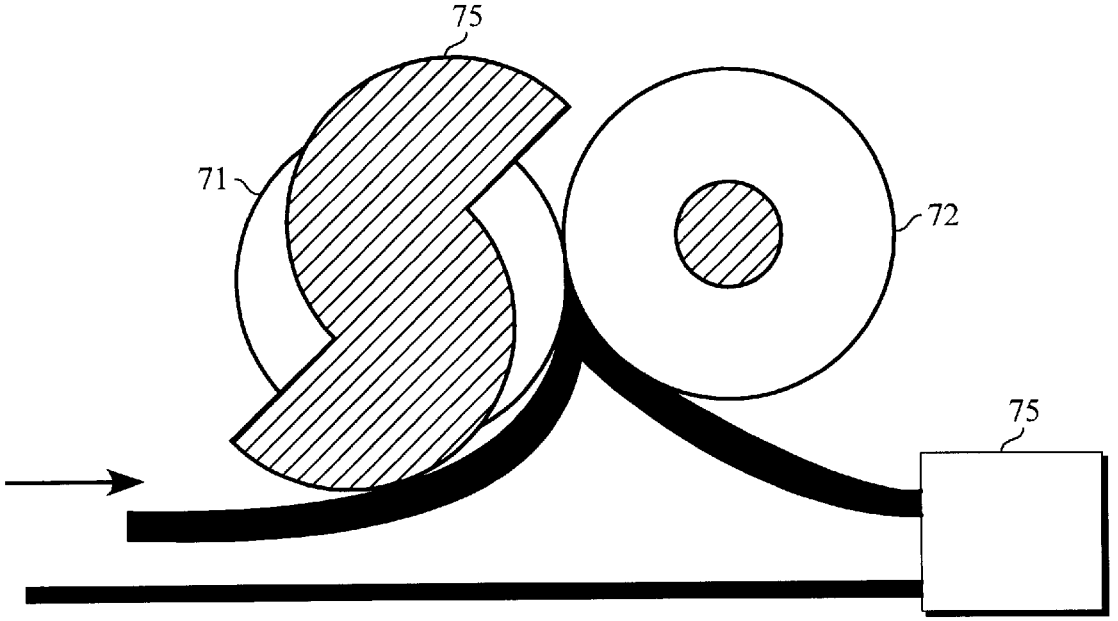

FIG. 15 shows a pair of nip rollers 71, 72, in which a buckling arrangement is provided, as represented by end stop 75. Roller 71 includes magnets, such as magnet 75. In this case, the buckling is used to help form and apex, and the magnets, such as magnet 75, are used to draw the buckled sheet between the nips 71, 72.

Figure 16:
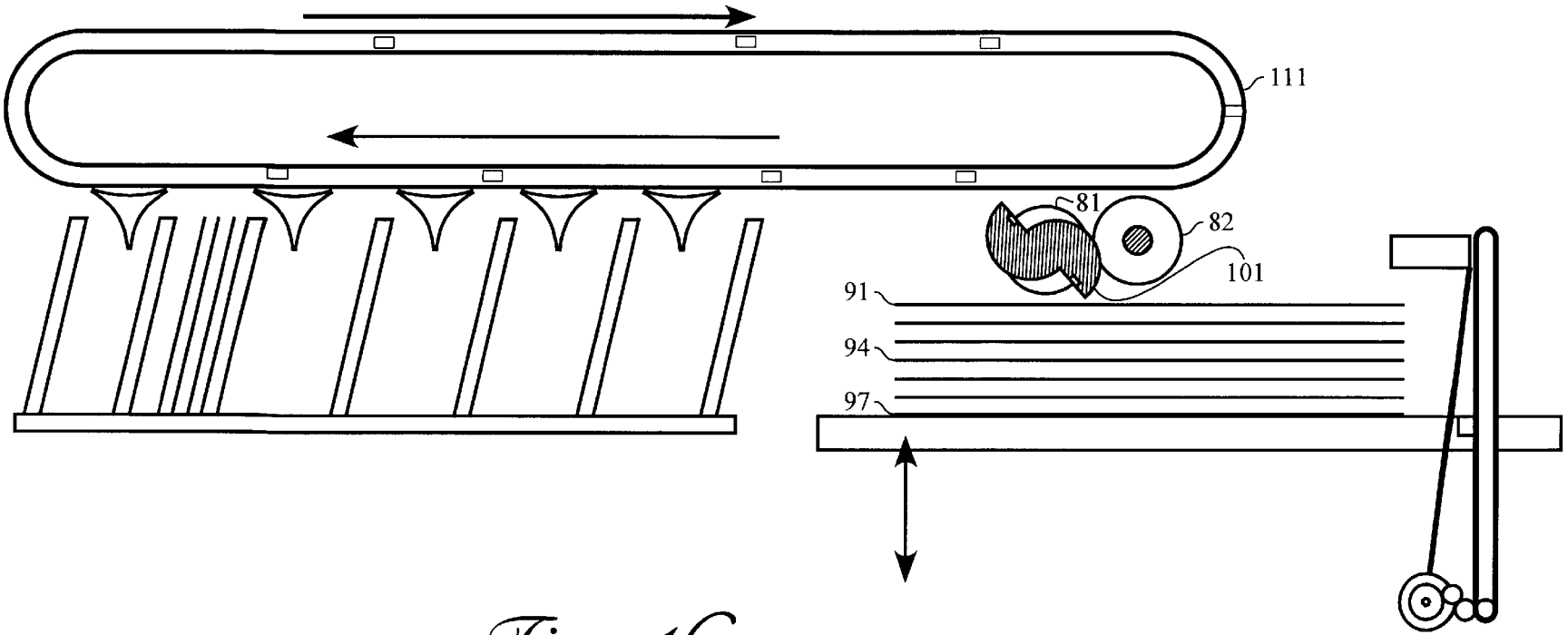
FIG. 16 shows a diverter pawl separating the document from the converter.
Figure 17:
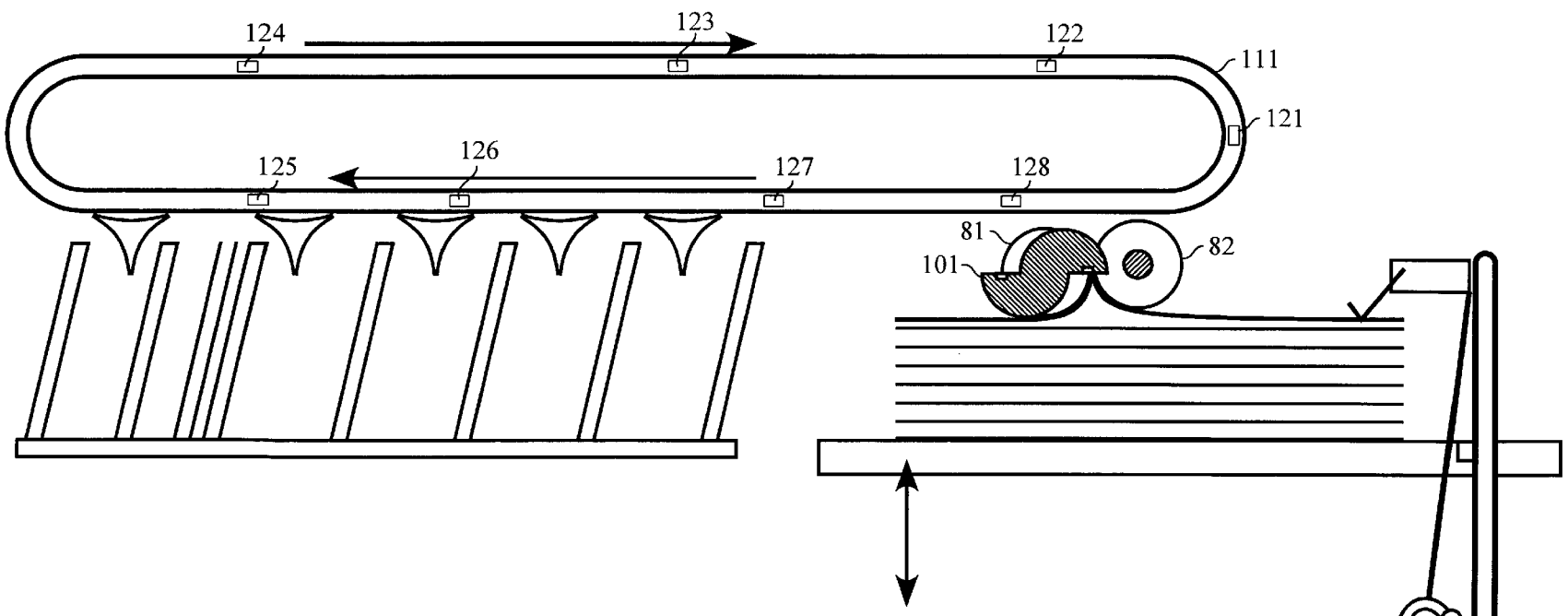
FIG. 17 shows the separated document dropped into a bin.

Referring to FIG. 16, paper movement is facilitated by using magnets. A pair of nip rollers 81, 82 are used to pick up individual ones of documents 91–97. FIG. 17 shows a top document 91 being picked up by the nips 81, 82. This is accomplished by magnets, such as magnet 101 shown on nib 81 picking up document 91 along a center line formed by staples. This creates a fold in the document 91 along its staple line. As the document 91 is passing between the rollers 81, 82, the document 91 comes into contact with a conveyer belt 111. The conveyer belt 111 includes a plurality of magnets 121–128. The magnets are positioned so that, when the document 91 passes through the nib rollers 81, 82 one of the magnets 121 aligns with the staples at the fold of the now-folded document 91.

Figure 18:
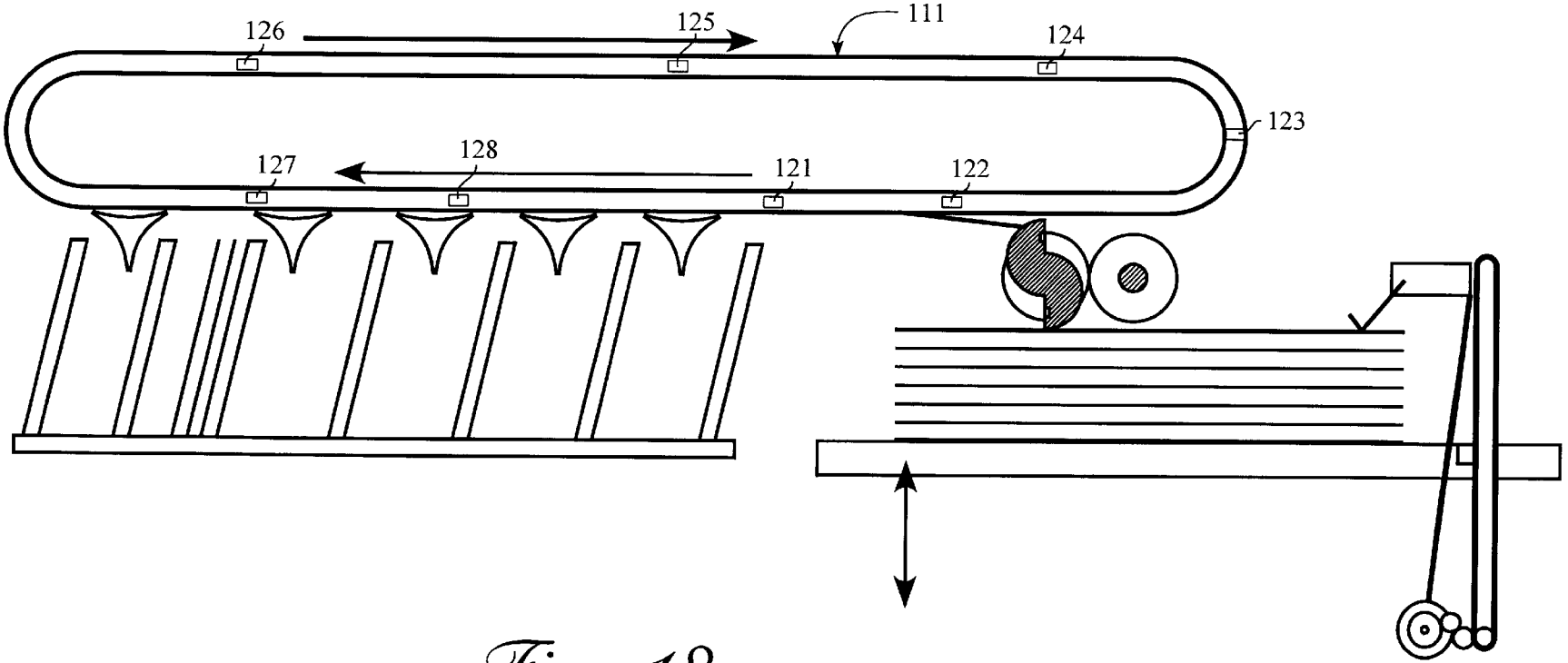
FIG. 18–21 shows the continued operation of the conveyor after the stack has been dropped into its bin.
Figure 19:
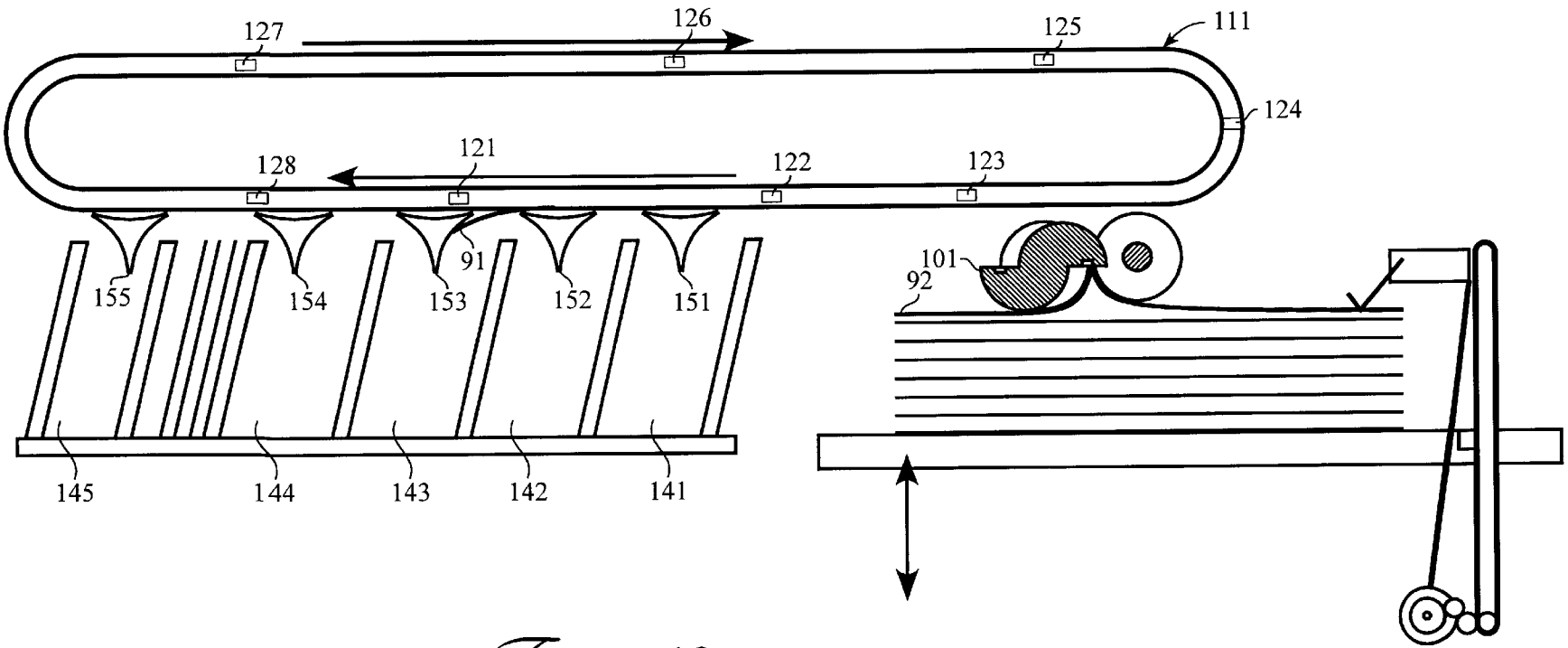
Figure 20:
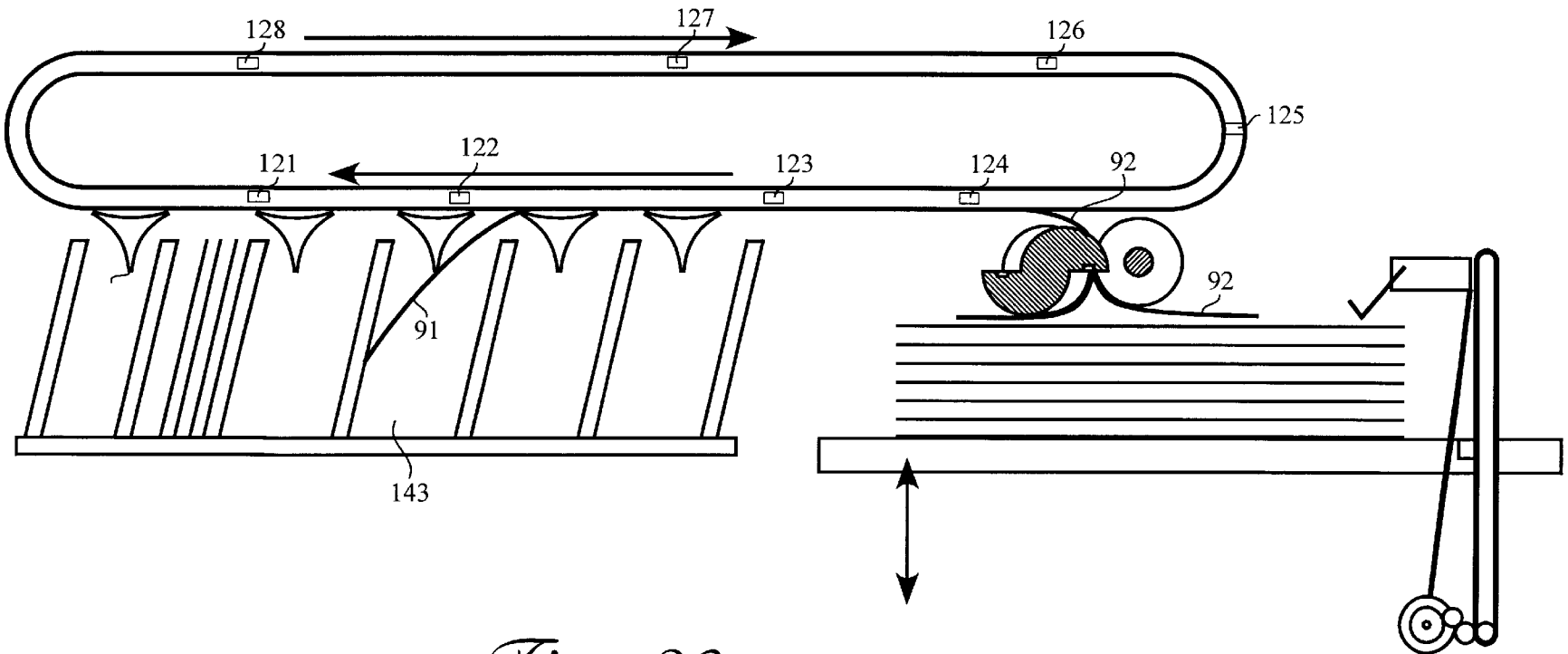
Figure 21:
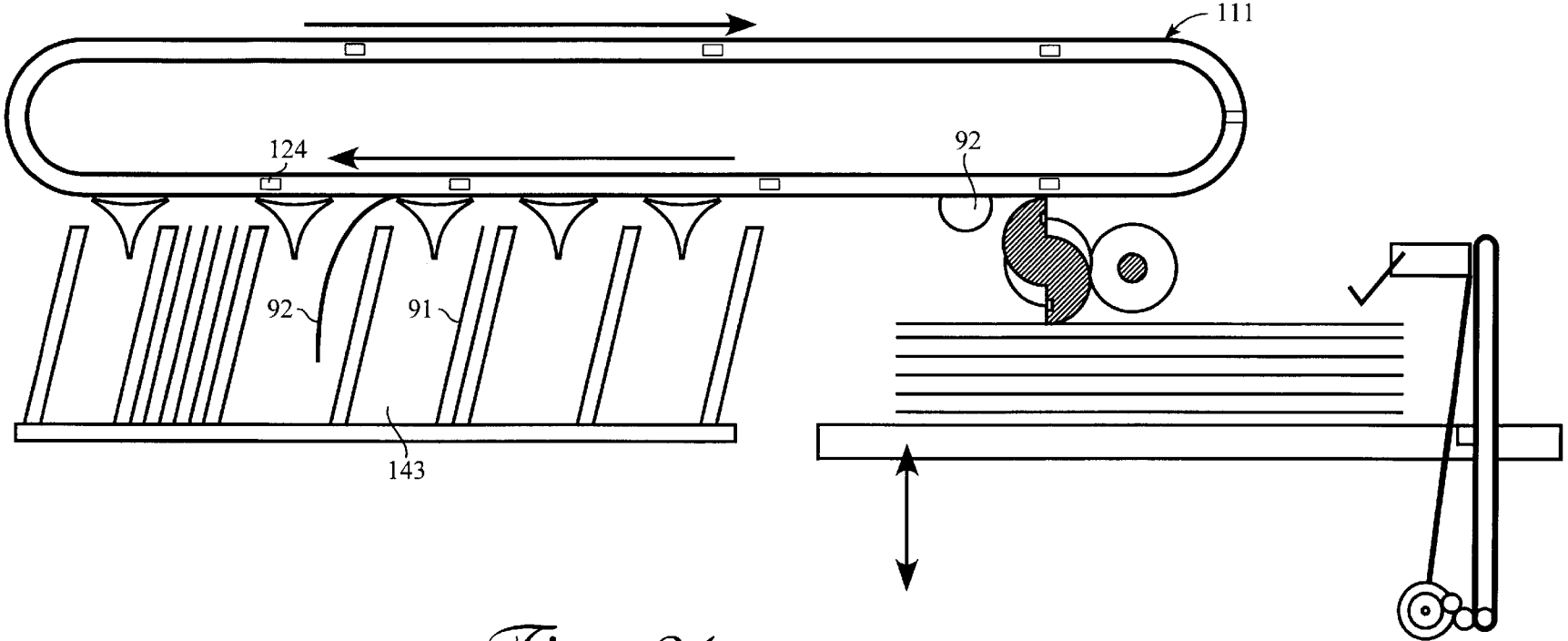

FIG. 18 shows the document 91 carried along the conveyer belt 111. Since the nip rollers 81, 82 continue to turn, the staples separate from the magnets 101 on the nip rollers 81, 81 and continue to passed along the direction of movement of the conveyer belt 111. Since magnet 121 is aligned with the staple line, that document 91 is carried along the conveyer belt 111 by the staples of the document 91. In FIG. 19, the document 91 has passed a pair of bins 141, 142 and is beginning to pass over bin 143. As can be seen, the document 91 has not yet passed over bins 144 and 145. Each of the bins 141–145 has a pawl 151–155 disposed over the respective bins. In FIGS. 19–20, pawl 153 over bin 143 has extended to separate the document 91 from the conveyer belt 111. This allows the document 91 to drop down into bin 143, as shown in FIG. 20. At the same time, a subsequent document 92 is being picked up by the magnets 101 and caused to pass through nip rollers 81, 82, is shown in FIGS. 19 and 20. In FIG. 21, that subsequent document 92 was carried by magnet 124 along conveyer belt 111.

As can be seen, a variety of configurations may be used in order to manipulate sheet media according to the present invention. The above embodiments are given only by way of example. For example, it is possible to provide the pair of magnets as a single magnet, having a length coincident with the length of the staples along the staple line. Accordingly, the invention should be read as limited only by the appended claims.

What is claimed is:

1. Method for manipulating stapled stacks of sheet material comprising:

a. identifying an alignment of a stack with respect to staples in said stack;

b. using magnetic force to align the stack by attracting the staples;

c. establishing, as said alignment, a fold line with respect to the staples;

d. using said magnetic force to withdraw the stacks at the fold line; and e. continuing said withdraw toward a creasing mechanism, the creasing mechanism capable of applying a folding force on the stack.

2. Method for manipulating stapled stacks of sheet material comprising:

a. identifying an alignment of a stack with respect to staples in said stack;

b. using magnetic force to align the stack by attracting the staples;

c. establishing, as said alignment, a fold line with respect to the staples;

d. using said magnetic force to withdraw the stacks at the fold line; and e. continuing said withdraw through a pair of nip rollers, thereby forming a crease in said stack in alignment with the staples.

3. The method as described in claim 2, further comprising:

urging the stack toward the nip rollers so that the magnetic force may attract the stack.

4. The method as described in claim 2, further comprising:

applying the magnetic force with at least two magnets.

5. The method as described in claim 2, further comprising:

applying the magnetic force with a single magnet.

6. Apparatus for manipulating sheet material, the apparatus comprising:

a. a mechanism capable of receiving plural sheets of the sheet material, and applying at least one ferromagnetic fastener for binding the stack, the plural sheets defining a stack;

b. a magnet for providing an alignment to the stack by attracting the fastener and manipulating the stack by said attraction of the fastener, and using that alignment; and c. a mechanism for performing a paper handling operation on the stack as aligned by the magnet, said mechanism providing a paper folding function.

7. Apparatus as described in claim 6, comprising:

the mechanism for performing the paper handling operation providing said paper folding function by use of a pair of nip rollers, by using the magnet to withdraw the stack between the pair of nip rollers.

8. Apparatus as described in claim 7, comprising:

a. a second magnet;

b. the mechanism applying at least the ferromagnetic fastener for binding the stack further applying a second ferromagnetic fastener to the stack; and c. the magnets located at positions along a length of one of said nip rollers in an alignment which coincides with anticipated positions of said ferromagnetic fasteners, thereby drawing the stack between the nip rollers in an alignment determined by the location of the fasteners.

9. Apparatus as described in claim 7, comprising:

further paper handling equipment receiving the stack from the nip rollers and manipulating the stack received from the nip rollers by magnetically attracting the fasteners.

10. Apparatus as described in claim 6, comprising:

a. the mechanism for performing the paper handling operation providing said paper folding function by use of a pair of nip rollers, by using the magnet to withdraw the stack between the pair of nip rollers; and b. said mechanism further including a blade to urge the stack toward the nip rollers.

11. Apparatus as described in claim 6, comprising:

a. the mechanism for performing the paper handling operation providing said paper folding function by use of a pair of nip rollers, by using the magnet to withdraw the stack between the pair of nip rollers; and b. said mechanism further including a buckling mechanism to urge the stack toward the nip rollers.

12. Apparatus as described in claim 7, comprising:

a. a second magnet;

b. the mechanism applying at least the ferromagnetic fastener for binding the stack further applying a second ferromagnetic fastener to the stack; and c. the magnets located at positions along a length of one of said nip rollers in an alignment which coincides with anticipated positions of said ferromagnetic fasteners, thereby drawing the stack between the nip rollers in an alignment determined by the location of the fasteners.

13. Post processing apparatus for manipulating sheet material discharged from an electrophotographic imaging machine, the apparatus comprising:

a. a mechanism capable of receiving plural sheets of the sheet material, and applying at least one ferromagnetic fastener for binding the stack, the plural sheets defining a stack;

b. a magnet for providing an alignment to the stack by attracting the fastener and manipulating the stack by said attraction of the fastener, and using that alignment; and c. a mechanism for performing a folding operation on the stack as aligned by the magnet by use of a pair of nip rollers, by using the magnet to withdraw the stack between the pair of nip rollers.

14. Apparatus as described in claim 13, comprising:

a. a second magnet;

b. the mechanism applying at least the ferromagnetic fastener for binding the stack further applying a second ferromagnetic fastener to the stack; and c. the magnets located at positions along a length of one of said nip rollers in an alignment which coincides with anticipated positions of said ferromagnetic fasteners, thereby drawing the stack between the nip rollers in an alignment determined by the location of the fasteners.

15. Apparatus as described in claim 14, comprising:

further paper handling equipment receiving the stack from the nip rollers and manipulating the stack received from the nip rollers by magnetically attracting the fasteners.

* * * * *